US009732698B2

(12) United States Patent
Batta et al.

(10) Patent No.: US 9,732,698 B2
(45) Date of Patent: Aug. 15, 2017

(54) TEMPERATURE REDUCING CHANNEL

(71) Applicant: Caterpillar Inc., Peoria, IL (US)

(72) Inventors: Christopher L. Batta, West Lafayette, IN (US); James A. Subatch, Jr., Mossville, IL (US); Amit Prakash Srivastava, Bangalore (IN)

(73) Assignee: Caterpillar Inc., Peoria, IL (US)

( * ) Notice: Subject to any disclaimer, the term of this patent is extended or adjusted under 35 U.S.C. 154(b) by 327 days.

(21) Appl. No.: 14/577,477

(22) Filed: Dec. 19, 2014

(65) Prior Publication Data

US 2016/0177862 A1 Jun. 23, 2016

(51) Int. Cl.

| | |
|---|---|
| ***F02F 1/02*** | (2006.01) |
| ***F02F 1/00*** | (2006.01) |
| *F02F 11/00* | (2006.01) |

(52) U.S. Cl.

CPC ..... *F02F 1/004* (2013.01); *F02F 1/02* (2013.01); *F02F 11/005* (2013.01); *F02F 2001/006* (2013.01)

(58) Field of Classification Search

CPC .. F02F 1/02; F02F 1/004; F02F 11/005; F02F 2001/006; F02F 1/10; F02F 1/16

See application file for complete search history.

(56) References Cited

U.S. PATENT DOCUMENTS

| | | | | |
|---|---|---|---|---|
| 4,776,303 | A | 10/1988 | Hundertmark | |
| 5,115,771 | A * | 5/1992 | Ozawa | F01P 3/02 123/193.2 |
| 2013/0032117 | A1* | 2/2013 | Worthington | F02F 1/004 123/193.2 |
| 2014/0216388 | A1 | 8/2014 | Strandburg et al. | |

FOREIGN PATENT DOCUMENTS

| | | | |
|---|---|---|---|
| CN | 200989252 | Y | 12/2007 |
| EP | 2647806 | A1 | 10/2013 |
| GB | 821308 | A | 10/1959 |
| JP | H08200062 | A | 8/1996 |

* cited by examiner

*Primary Examiner* — Jacob Amick

(74) *Attorney, Agent, or Firm* — Miller, Matthias & Hull

(57) ABSTRACT

A cylinder liner for an engine is disclosed. The cylinder liner may include a cylindrical sleeve with an inner surface and an outer surface extending axially from a first end to a second end. The cylinder liner may also include a void disposed in the first end and concentric to the inner surface of the cylindrical sleeve.

11 Claims, 5 Drawing Sheets

TEMPERATURE REDUCING CHANNEL

FIELD OF THE DISCLOSURE

The present disclosure relates generally to internal combustion engines and, more particularly, to a cylinder liner for an internal combustion engine.

BACKGROUND OF THE DISCLOSURE

Internal combustion engines, such as diesel or gasoline engines, generally include a cylinder block with a plurality of piston bores. In order to generate mechanical power, pistons reciprocate within the cylinder bores. Each of the cylinder bores typically include a replaceable cylinder liner sized to fit within the cylinder bore. The cylinder liner may generally be a cylindrically shaped sleeve that has an inner surface which serves as a sliding surface for the piston rings.

Cylinder liners provide numerous advantages to an internal combustion engine. For example, after significant wear of cylinder liners over time due to normal operation of the engine, the cylinder liners can be easily removed and replaced without replacing the entire cylinder block. Thus, most improvements in cylinder liners are directed to reducing wear of the liners, which may negatively impact engine performance.

One such improvement is disclosed in U.S. Patent Application Publication No. 2014/0216388 A1, entitled, "Engine Cylinder Mid-Stop." The 2014/0216388 publication describes an engine cylinder mid-stop for supporting a cylinder liner. Formed in a side wall of the cylinder, the mid-stop includes a first contact surface and an undercut between the first contact surface and the side wall. The cylinder liner includes a second contact surface, which is supported by the first contact surface of the mid-stop. The undercut of the mid-stop reduces motion between the first and second contact surfaces, thereby reducing wear between the cylinder and liner. While effective, the 2014/0216388 publication only addresses the problem of cylinder liner wear.

However, further improvements in cylinder liners are desired to address problems other than wear of the cylinder liner. More specifically, the temperature within the O-ring groove of the cylinder liner may exceed material capabilities of the O-ring, thereby resulting in failure of the sealing joint and causing an external coolant leak. Accordingly, improvements in cylinder liners are needed to reduce O-ring groove temperatures.

SUMMARY OF THE DISCLOSURE

In accordance with one embodiment, a cylinder liner for an engine is disclosed. The cylinder liner may include a cylindrical sleeve including an inner surface and an outer surface extending axially from a first end to a second end. The cylinder liner may also include a void disposed in the first end and concentric to the inner surface of the cylindrical sleeve.

In accordance with another embodiment, an engine is disclosed. The engine may include a cylinder block including a cylinder bore, and a cylinder liner positioned in the cylinder bore. The cylinder liner may include a cylindrical sleeve with an inner surface and an outer surface extending axially from a first end to a second end; a sealant groove disposed on the outer surface proximate the first end; and a void disposed on the top surface of the first end and positioned radially inward of the sealant groove. The void may be designed to reduce a temperature within the sealant groove.

In yet another embodiment, a method for reducing a temperature of a sealant groove in a cylinder liner of an engine is disclosed. The method may include providing a void in the cylinder liner proximate the sealant groove, operating the engine, and disrupting a thermal gradient of the cylinder liner using the void.

These and other aspects and features will become more readily apparent upon reading the following detailed description when taken in conjunction with the accompanying drawings. In addition, although various features are disclosed in relation to specific exemplary embodiments, it is understood that the various features may be combined with each other, or used alone, with any of the various exemplary embodiments without departing from the scope of the disclosure.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

The present disclosure provides an engine cylinder liner that reduces cylinder liner sealant groove temperatures. A channel, trough, or other void is machined or otherwise formed on a top of the cylinder liner. Furthermore, the void may extend down into the cylinder liner behind a sealant groove. In so doing, the void disrupts a thermal gradient of the liner, reducing the temperature in the sealant groove. By reducing sealant groove temperatures, the void protects against breakdown of the cylinder liner sealing joint, thereby preventing external coolant leaks.

Reference will now be made in detail to specific embodiments or features, examples of which are illustrated in the accompanying drawings. Generally, corresponding reference numbers will be used throughout the drawings to refer to the same or corresponding parts.

Figure 1:
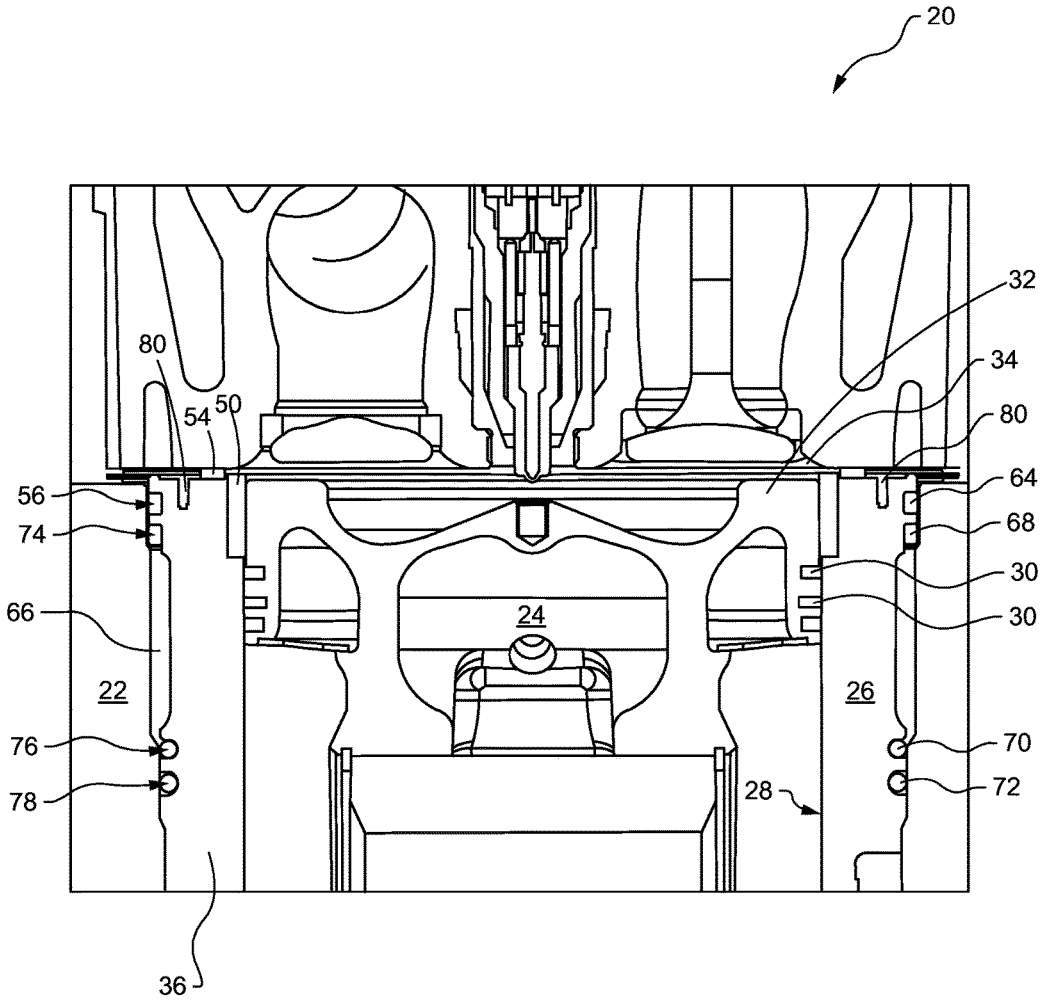
FIG. 1 is a cross-sectional view of part of an engine, constructed in accordance with an embodiment of the present disclosure.

FIG. 1 illustrates a cross-sectional view of part of an engine 20 consistent with certain embodiments of the present disclosure. The engine 20 may be used in any type of vehicle or machine that performs a driven operation involving physical movement associated with a particular industry, such as, without limitation, transportation, mining, construction, landscaping, forestry, agriculture, etc. Non-limiting examples of vehicles and machines, for both commercial and industrial purposes, include locomotives, vehicles, loaders, excavators, dozers, motor graders, tractors, trucks, backhoes, agricultural equipment, material handling equipment, marine vessels, and other types that operate in a work environment. It is to be understood that the engine 20 is shown primarily for illustrative purposes to assist in disclosing features of various embodiments, and that FIG. 1 does not depict all of the components of an engine.

The engine 20 may include a cylinder block 22 with at least one cylinder bore 24. A cylinder liner 26 may be mounted within the cylinder bore 24 in order to provide a running surface 28 for piston rings 30 of a piston 32. Enclosing a combustion chamber of the engine 20 within the cylinder bore 24, a cylinder head 34 may be secured to the cylinder block 22. The combustion chamber may be bounded by the running surface 28 of the cylinder liner 26. During engine operation, the piston 32 may reciprocate in the cylinder bore 24 to generate mechanical energy from the chemical energy produced through combustion of a fuel within the combustion chamber.

Figure 2:
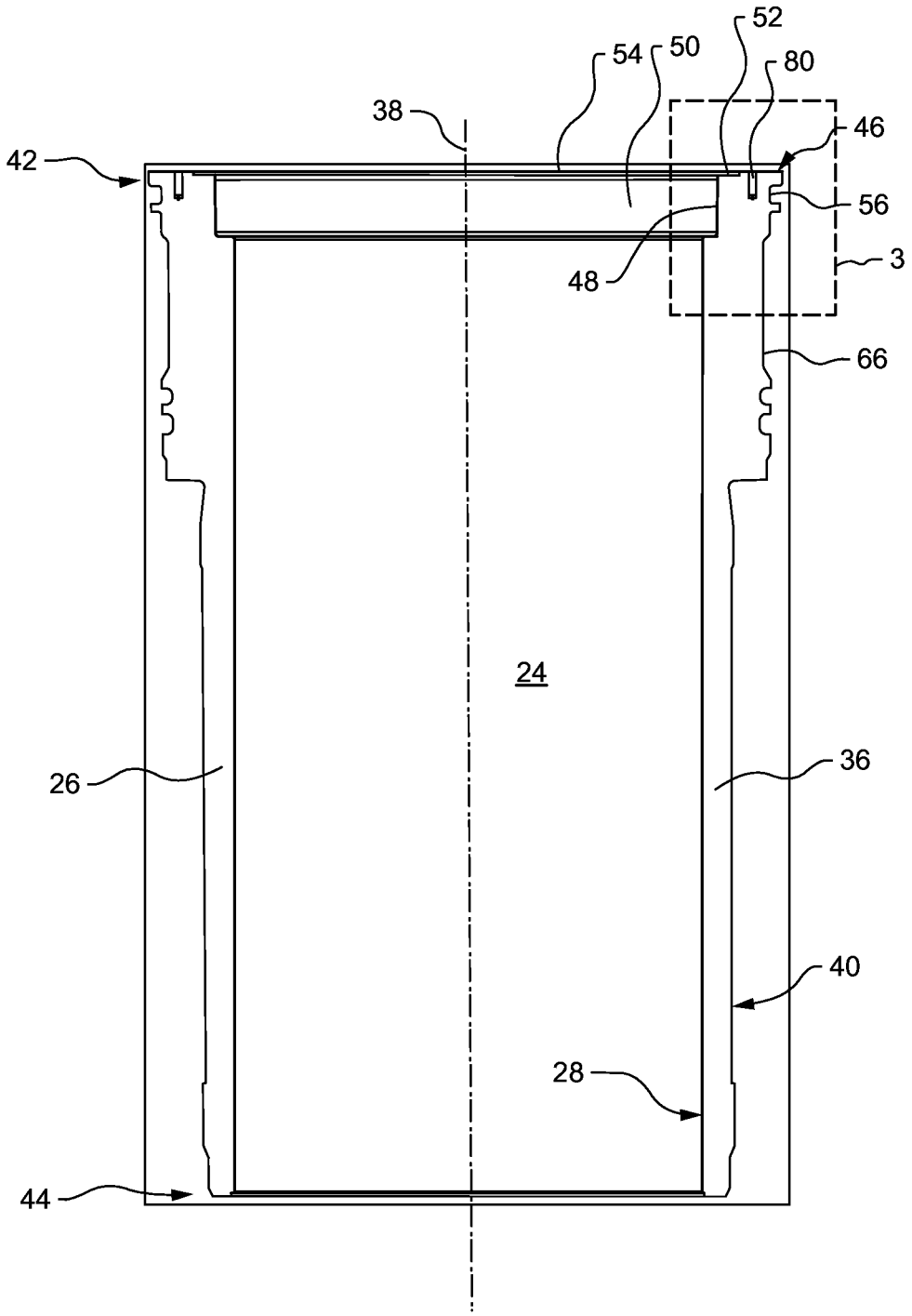
FIG. 2 is a cross-sectional view of a cylinder liner for the engine of FIG. 1.
Figure 3:
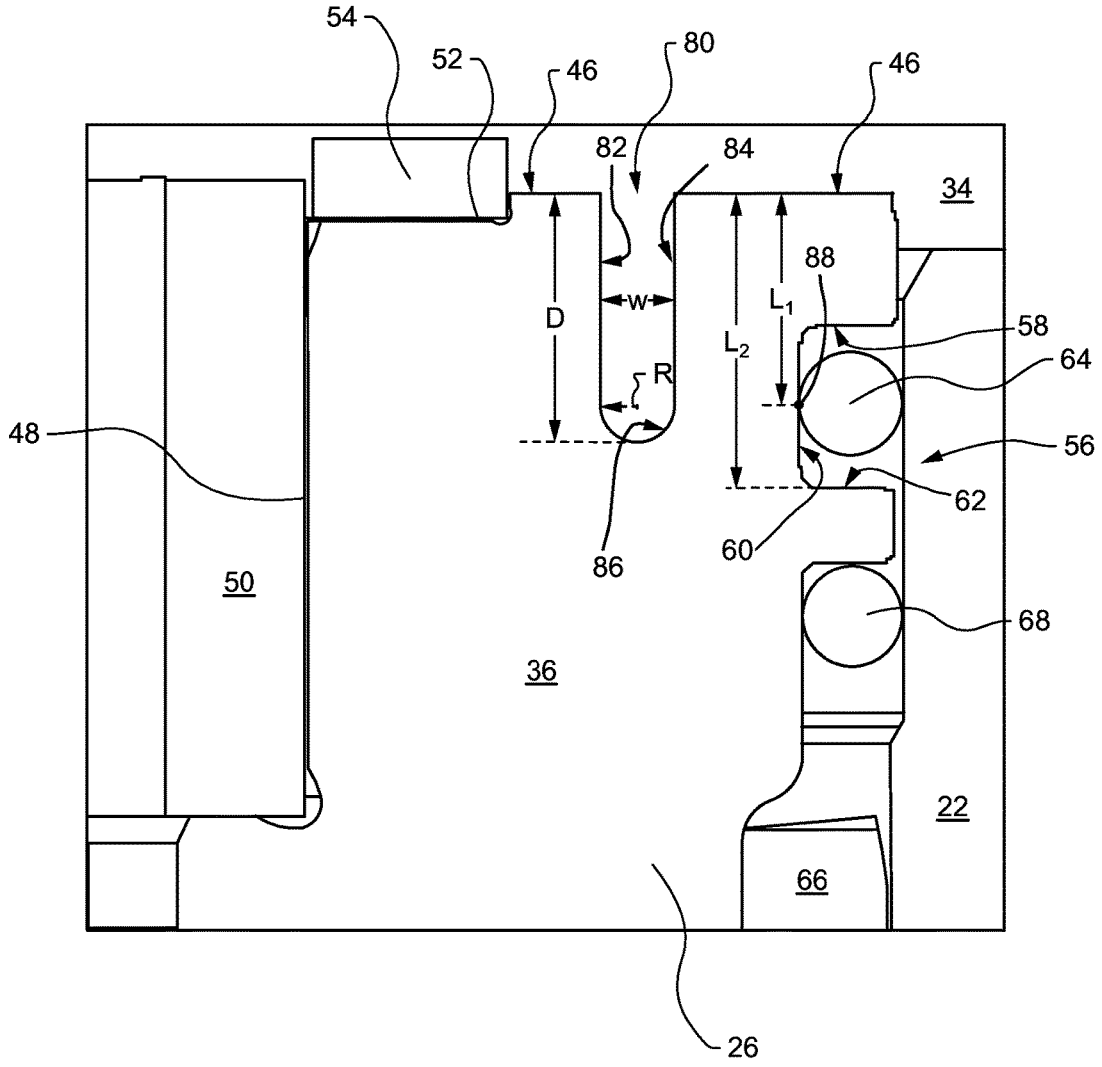
FIG. 3 is an enlarged view of region 3 in the cylinder liner of FIG. 2.
Figure 4:
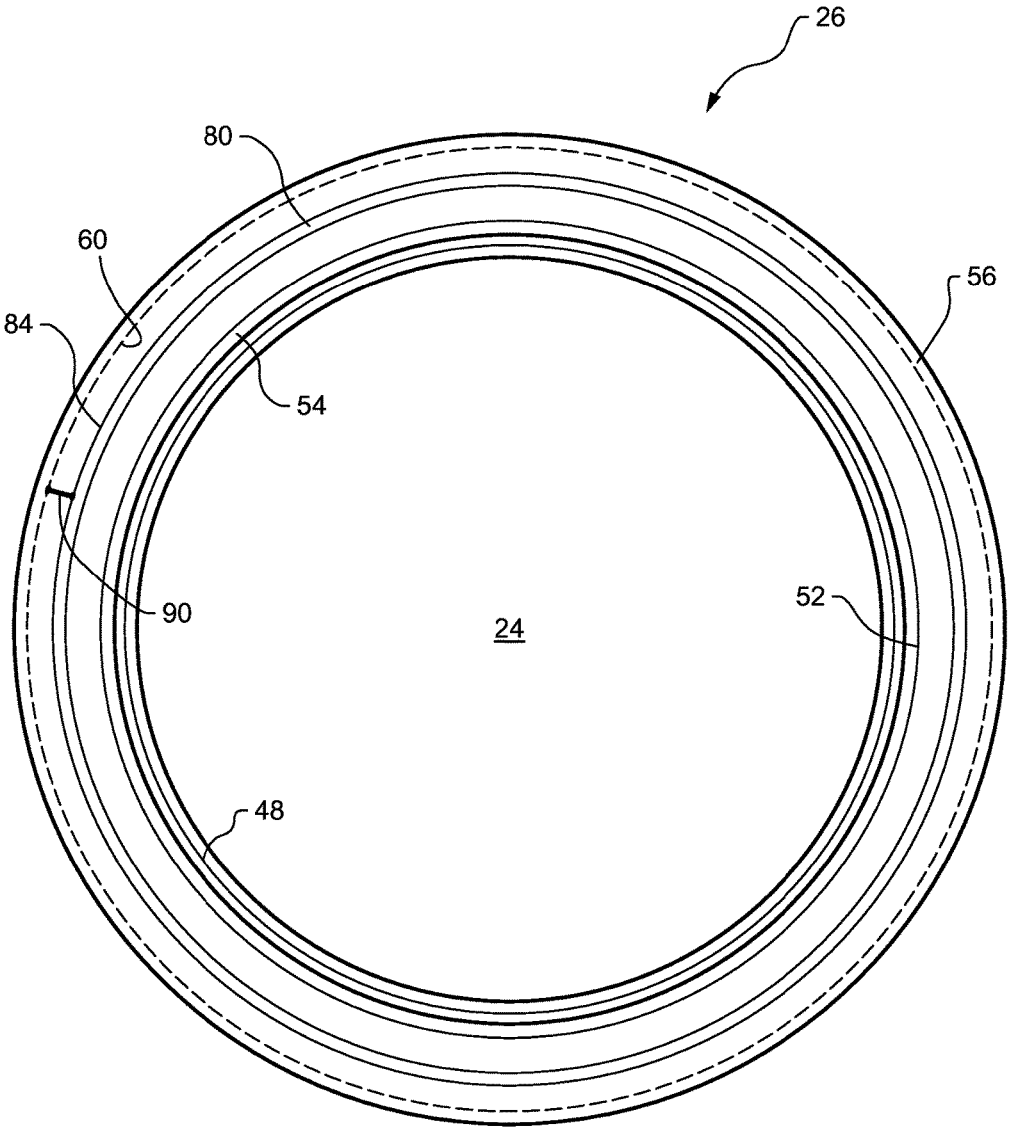
FIG. 4 is a top view of the cylinder liner of FIG. 2.

Referring now to FIGS. 2-4, with continued reference to FIG. 1, the cylinder liner 26 may comprise a cylindrical sleeve 36 extending along a longitudinal axis 38. The cylindrical sleeve 36 may include an inner surface, or running surface 28, and an outer surface 40 extending axially from a first end 42 to a second end 44. The first end 42 may include a top surface 46 extending between the inner surface 28 and the outer surface 40. The top surface 46 may mate with the cylinder head 34 in order to seal the combustion chamber.

Furthermore, the first end 42 of the cylinder liner 26 may include a cuff-ring groove 48 disposed on the inner surface 28. For example, the cuff-ring groove 48 may comprise a step-like groove that extends from the inner surface 28 to the top surface 46 of the cylinder liner 26. However, other configurations for the cuff-ring groove 48 may be used. An anti-polish ring or cuff-ring 50 may be located in the cuff-ring groove 48 for removal of combustion product deposits on a top rim of the piston 32.

The first end 42 of the cylinder liner 26 may also include a lip 52 on the top surface 46 adjacent to the cuff-ring groove 48. A fire ring 54 on top of the first end 42 of the cylinder liner 26 may be used to seal the extremely high pressure and high temperature combustion gases between the cylinder liner 26 and the cylinder head 34. The lip 52 may protect the top surface 46 of the cylinder liner 26 that the fire ring 54 is located on from damage.

In addition, the cylinder liner 26 may include an upper cylinder liner sealant groove 56, such as an O-ring groove, disposed on the outer surface 40 of the cylindrical sleeve 36 proximate the first end 42. The upper sealant groove 56 may comprise a substantially U-shaped cavity (in cross-section) formed by a first surface 58, a second surface 60, and a third surface 62, although other configurations may be used. An elastomeric gasket or other sealant 64, such as an O-ring, may be located in the upper sealant groove 56 in order to contain engine coolant between the cylinder block 22 and the cylinder liner 26.

The sealant 64 may be comprised of elastomer, or other suitable materials, and may be designed to be seated in the upper sealant groove 56 and compressed between the cylinder liner 26 and the cylinder block 22, creating a seal at said interface. Due to the high-temperature combustion gases, engine coolant may flow around the cylinder liner 26 through passage 66 (FIG. 1) in order to cool the cylinder liner 26. Furthermore, more than one sealant 64 may be used to contain the engine coolant. For instance, as shown in FIG. 1, the engine 20 may include two upper sealants 64, 68 and two lower sealants 70, 72 disposed in sealant grooves 56, 74, 76, and 78.

Temperatures in the upper sealant groove 56 may exceed the material capabilities of the sealant 64, which may result in thermal degradation and lead to failure of the sealing joint, causing an external coolant leak. In order to reduce the upper sealant groove 56 temperature, the cylinder liner 26 may include an air channel, trough, or void 80, in accordance with an embodiment of the present disclosure. For example, the void 80 may be disposed on the top surface 46 of the first end 42 and may extend axially into the cylinder liner 26 behind the upper sealant groove 56.

More specifically, the void 80 may include a radially inner surface 82 and a radially outer surface 84 spaced apart from and parallel to the radially inner surface 82. Each of the radially inner and outer surfaces 82, 84 may extend from the top surface 46 in a direction toward the second end 44 of the cylinder liner 26. The radially inner and outer surfaces 82, 84 may be concentric to the longitudinal axis 38 of the cylinder liner 26. The radially inner surface 82 and the radially outer surface 84 may converge to a curved bottom surface 86.

In so doing, the void 80 creates an opening in the top surface 46, which disrupts the thermal gradient of the cylinder liner 26. Furthermore, the void 80 may extend to a predetermined depth D proximate the upper sealant groove 56 in order to reduce temperatures therein. For example, the radially outer surface 84 of the void 80 may be located parallel to the second surface 60 of the sealant groove 56, and the predetermined depth D of the void 80 may extend to a depth between the first surface 58 and the third surface 62 of the sealant groove 56.

More specifically, the predetermined depth D of the void 80 may be based on a location of the upper sealant groove 56. In one example, the predetermined depth D may be approximately equal to a first length $L_1$ measured from the top surface 46 to a midpoint 88 of the upper sealant groove 56. In another example, the predetermined depth D may be approximately equal to a second length $L_2$ measured from the top surface 46 to the third surface 62 of the upper sealant groove 56. The predetermined depth D may also be approximately equal to any length between the first length $L_1$ and the second length $L_2$. However, other predetermined depths D are certainly possible.

For instance, the predetermined depth D may be between an inclusive range of 2 mm to 12 mm, depending on the location of the upper sealant groove 56. The void 80 may have a width W between an inclusive range of 2 mm to 6 mm, and the curved bottom surface 86 may have a radius R between an inclusive range of 1 mm to 3 mm. However, other numerical ranges for the dimensions of the void 80 are certainly possible.

As shown in the top view of FIG. 4, the void 80 may extend around an entire circumference of the cylinder liner 26 and may be concentric to the inner surface 28. The void 80 may be positioned radially inward of the upper sealant groove 56 and radially outward of the fire ring 54 and the cuff-ring groove 48. In one example, the void 80 may be located approximately midway between the upper sealant groove 56 and the fire ring 54, although other locations may be used. Moreover, a radial distance 90 between the radially outer surface 84 of the void 80 and the second surface 60 of the upper sealant groove may also be based on structural considerations of the cylinder liner 26.

It is to be understood that other configurations for the void 80 may be used. Furthermore, although described in conjunction with the upper sealant groove 56, one or more voids may be used to reduce temperatures in the other sealant grooves 74, 76, and 78 or other components of the cylinder liner 26. For example, the trough need not be provided in the shape and location described and illustrated. Rather, other voids of different shapes, dimensions, and locations may be used with varying efficacy as long as they sufficiently disrupt the thermal gradient of the cylinder liner. The void need not extend to the top surface 46 but could be provided as self-contained pockets in the cylinder liner proximate the sealant groove 56. Such pockets could be provided as annular rings which circumscribe the cylinder liner or as intermittent pockets or voids.

INDUSTRIAL APPLICABILITY

In general, the foregoing disclosure finds utility in various industrial applications, such as, in transportation, mining, earthmoving, construction, industrial, agricultural, and forestry vehicles and machines. In particular, the disclosed cylinder liner may be applied to engines of locomotives, vehicles, loaders, excavators, dozers, motor graders, tractors, trucks, backhoes, agricultural equipment, material handling equipment, marine vessels, and the like. By applying the disclosed cylinder liner to an engine, cylinder liner sealant groove temperatures may be significantly reduced. In particular, the disclosed cylinder liner includes an air channel or trough which disrupts the thermal gradient of the cylinder liner, thereby reducing temperatures in the sealant groove. In so doing, the trough protects against breakdown of the cylinder liner sealing joint and prevents external coolant leaks.

Figure 5:
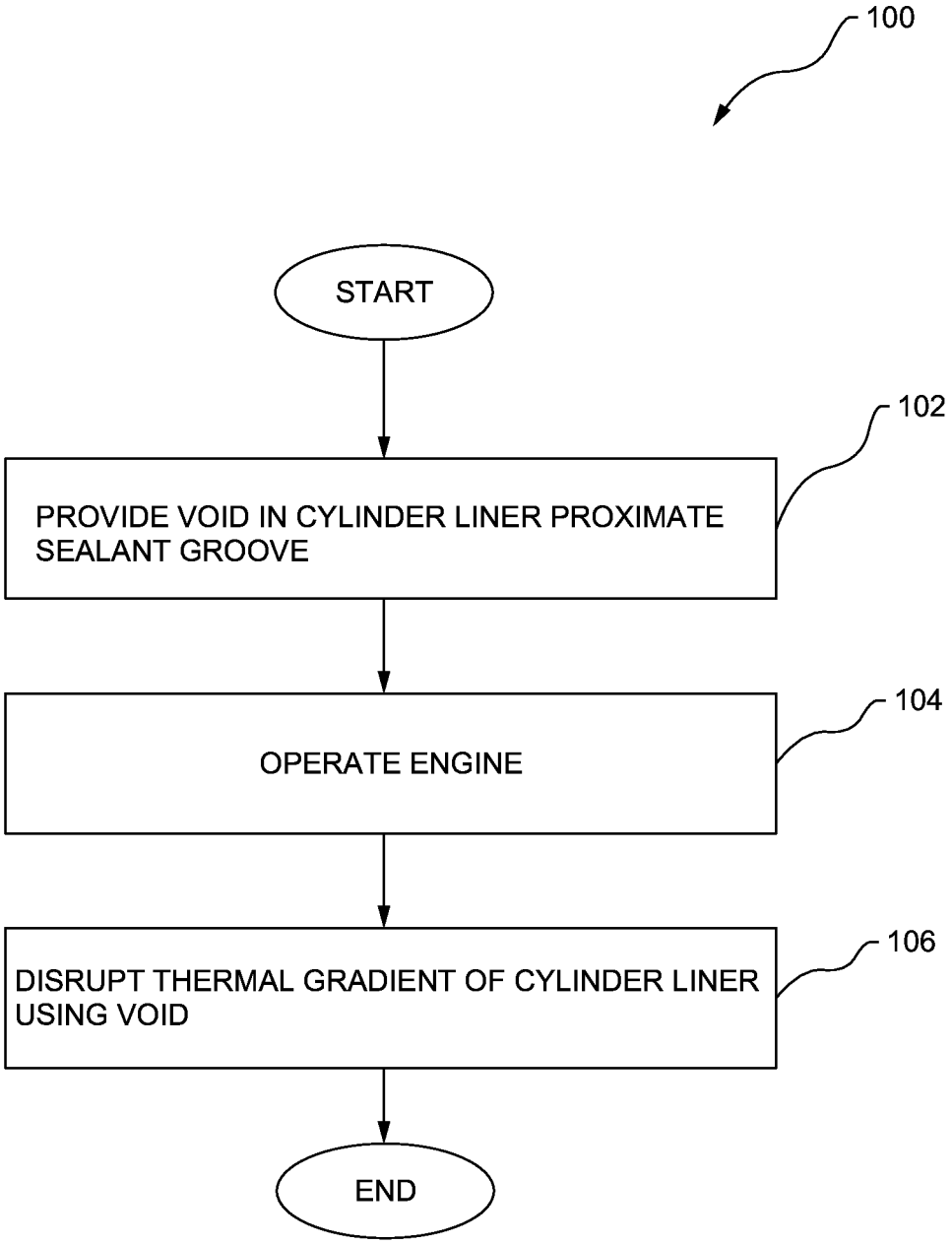
FIG. 5 is a flowchart illustrating a process for reducing a temperature of a sealant groove in a cylinder liner of an engine, in accordance with yet another embodiment.

Turning now to FIG. 5, with continued reference to FIGS. 1-4, a flowchart illustrating an example process 100 for reducing a temperature of a sealant groove 56 in a cylinder liner 26 of an engine 20 is shown, according to another embodiment of the present disclosure. The process 100 may comprise providing a void 80 in the cylinder liner 26 proximate the sealant groove 56 at block 102. At block 104, the process 100 may further comprise operating the engine 20. At block 106, the process 100 may further comprise disrupting a thermal gradient of the cylinder liner 26 using the void 80. It is to be understood that the flowchart in FIG. 5 is shown and described as an example only to assist in disclosing the features of the disclosed system, and that more steps than that shown may be included in the method corresponding to the various features described above for the disclosed system without departing from the scope of the disclosure.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A cylinder liner for an engine, comprising:

a cylindrical sleeve including an inner surface and an outer surface extending axially from a first end to a second end;

a void disposed in the first end and concentric to the inner surface of the cylindrical sleeve, a sealant groove disposed on the outer surface of the cylindrical sleeve proximate the first end, wherein the void is positioned radially inward of the sealant groove, wherein the void is configured to reduce a temperature of the sealant groove, and wherein the void extends axially from a top surface to a predetermined depth, the predetermined depth based on a location of the sealant groove; and a fire ring disposed on the top surface of the first end, wherein the void is positioned radially outward of the fire ring, wherein the void is positioned midway between the sealant groove and the fire ring.

2. The cylinder liner of claim 1, wherein the void includes a radially inner surface and a radially outer surface spaced apart from and parallel to the radially inner surface.

3. The cylinder liner of claim 2, wherein the void includes a curved surface extending between the radially inner surface and the radially outer surface.

4. The cylinder liner of claim 1, wherein the void extends around an entire circumference of the cylinder liner.

5. An engine, comprising:

a cylinder block including a cylinder bore; and a cylinder liner positioned in the cylinder bore, the cylinder liner including:

a cylindrical sleeve with an inner surface and an outer surface extending axially from a first end to a second end;

a sealant groove disposed on the outer surface proximate the first end;

a void disposed in the first end and positioned radially inward of the sealant groove, the void designed to reduce a temperature within the sealant groove; and a cuff-ring groove disposed on the inner surface of the cylindrical sleeve proximate the first end, and a fire ring disposed in the first end and adjacent to the cuff-ring groove, wherein the void is positioned radially outward of the cuff-ring groove and the fire ring, and wherein the void is positioned midway between the sealant groove and the fire ring.

6. The engine of claim 5, wherein the void extends axially to a predetermined depth, the predetermined depth based on a location of the sealant groove.

7. The engine of claim 6, wherein the predetermined depth is between an inclusive range of a first depth to a second depth, the first depth approximately equal to a first length measured from a top surface of the cylindrical sleeve to a midpoint of the sealant groove, and the second depth approximately equal to a second length measured from the top surface of the cylindrical sleeve to a third surface of the sealant groove.

8. The engine of claim 7, wherein the void includes a radially inner surface, a radially outer surface spaced apart from and parallel to the radially inner surface, and a curved surface connecting the radially inner and outer surfaces, the radially inner and outer surfaces extending axially from the top surface of the cylindrical sleeve to the curved surface.

9. The engine of claim 8, wherein the radially outer surface is parallel to a second surface of the sealant groove.

10. The engine of claim 9, wherein each of the radially inner surface and the radially outer surface are concentric to a longitudinal axis of the cylinder liner.

11. The engine of claim 5, wherein the void extends around an entire circumference of the cylinder liner.

* * * * *